US010201735B2

(12) United States Patent
Goldberg

(10) Patent No.: US 10,201,735 B2
(45) Date of Patent: Feb. 12, 2019

(54) HEATING A SPORTS DEVICE

(71) Applicant: Robert Marc Goldberg, Fayetteville, NY (US)

(72) Inventor: Robert Marc Goldberg, Fayetteville, NY (US)

( * ) Notice: Subject to any disclaimer, the term of this patent is extended or adjusted under 35 U.S.C. 154(b) by 0 days.

(21) Appl. No.: 14/986,653

(22) Filed: Jan. 2, 2016

(65) Prior Publication Data

US 2016/0193514 A1 Jul. 7, 2016

Related U.S. Application Data

(60) Provisional application No. 62/099,215, filed on Jan. 2, 2015.

(51) Int. Cl.
*A63B 65/12* (2006.01)
*A63B 60/06* (2015.01)
*A63B 102/14* (2015.01)

(52) U.S. Cl.
CPC ..... *A63B 60/06* (2015.10); *A63B 2102/14* (2015.10); *A63B 2225/64* (2013.01)

(58) Field of Classification Search
CPC .. A63B 60/06; A63B 2225/64; A63B 2102/14
USPC ..... 473/513
See application file for complete search history.

(56) References Cited

U.S. PATENT DOCUMENTS 744,739 A * 11/1903 Fliess ..... H05B 3/00 219/201
2,997,042 A * 8/1961 Mitchell ..... A01K 87/085 126/208
3,164,921 A 1/1965 Mavrakis
3,707,279 A 12/1972 Kaiser
3,837,394 A * 9/1974 Roberts, Jr. ..... F28D 15/06 165/104.21
4,259,401 A 3/1981 Chahroudi et al.
4,440,421 A * 4/1984 Adamson ..... A63C 11/222 219/201
4,471,209 A * 9/1984 Hollander ..... H05B 3/46 16/421
4,512,574 A * 4/1985 Klaila ..... A63B 49/08 473/550
4,598,192 A 7/1986 Garnett
4,616,699 A * 10/1986 Grote ..... F28D 15/046 122/366
4,631,976 A * 12/1986 Noda ..... B62D 1/065 219/204
4,646,461 A * 3/1987 McLeod ..... A01K 87/085 126/206

(Continued)

FOREIGN PATENT DOCUMENTS

GB 2511570 A 9/2014

OTHER PUBLICATIONS

US 5,789,574, 07/1998, Garnett (withdrawn)

*Primary Examiner* — Melba Bumgarner
*Assistant Examiner* — Joseph B Baldori
(74) *Attorney, Agent, or Firm* — Paul Frank + Collins P.C.

(57) ABSTRACT

A sports device configured to generate thermal energy to warm surfaces. In one implementation, the sports device embodies a lacrosse stick with a shaft and head. The shaft includes a thermal core with a phase change material that can retain and dissipate heat over an extended period of time.

14 Claims, 14 Drawing Sheets

(56) References Cited

U.S. PATENT DOCUMENTS 4,709,750 A * 12/1987 White ..... F28D 20/021 126/400
4,807,696 A 2/1989 Colvin et al.
4,937,429 A * 6/1990 Hollander ..... B62D 1/065 219/202
4,979,923 A * 12/1990 Tanaka ..... A61F 7/007 219/201
5,517,786 A 5/1996 Peissig
5,585,026 A 12/1996 Smith, Jr. et al.
5,613,407 A * 3/1997 Ogata ..... B62J 33/00 219/204
5,687,705 A 11/1997 Blair
5,687,706 A 11/1997 Goswami et al.
5,722,482 A * 3/1998 Buckley ..... A61F 7/02 165/10
5,786,574 A 7/1998 Garnett
5,816,933 A 10/1998 Huang
5,823,901 A 10/1998 Burger
5,834,734 A * 11/1998 Ogata ..... H05B 3/00 219/204
5,834,738 A 11/1998 Wilson
5,884,006 A 3/1999 Frohlich et al.
5,934,267 A 8/1999 Briner
5,947,585 A * 9/1999 Hill ..... F21L 2/00 219/220
5,955,188 A * 9/1999 Pushaw ..... B32B 5/18 428/320.2
5,973,294 A * 10/1999 Schatt ..... A47L 1/16 219/228
6,079,404 A 6/2000 Salyer
6,222,159 B1 4/2001 Healy
6,247,469 B1 * 6/2001 Guard ..... A63B 71/0045 126/229
6,353,211 B1 3/2002 Chen
6,686,572 B1 * 2/2004 Wu ..... B62J 33/00 219/202
6,727,467 B1 * 4/2004 Hadzizukic ..... B62D 1/065 219/204
6,756,573 B2 6/2004 Cornell
6,998,576 B2 2/2006 Marquis
7,035,532 B2 4/2006 Kudo
7,091,450 B1 * 8/2006 Hollander ..... B62J 33/00 219/202
7,119,304 B2 * 10/2006 Meyers ..... A63C 11/222 124/86
7,214,906 B1 5/2007 Hansen et al.
7,238,920 B1 7/2007 Prieto et al.
7,651,418 B2 1/2010 Appleton et al.
7,805,812 B2 * 10/2010 Ohishi ..... B62K 21/26 16/421
7,849,613 B2 12/2010 Kornienko
7,981,502 B2 * 7/2011 Lammer ..... A63B 49/08 428/304.4
8,294,066 B2 10/2012 Gill et al.
8,558,140 B2 10/2013 Hazlett et al.
8,820,523 B1 9/2014 Breza et al.
8,834,305 B2 9/2014 Cain
9,821,204 B2 11/2017 Wolfe et al.
2003/0170013 A1 9/2003 Patshkowski et al.
2003/0218007 A1 * 11/2003 Cornell ..... A63B 53/14 219/541
2005/0103769 A1 * 5/2005 Marquis ..... A01K 87/085 219/204
2005/0277494 A1 12/2005 Goss
2007/0007266 A1 1/2007 Sasaki et al.
2007/0251844 A1 11/2007 Reid
2008/0272102 A1 11/2008 Farrington
2008/0272103 A1 11/2008 Farrington
2008/0272104 A1 11/2008 Farrington
2011/0232038 A1 9/2011 Miller
2012/0129623 A1 * 5/2012 Gill ..... A63B 53/14 473/300
2012/0202622 A1 * 8/2012 Sena ..... A63B 69/00 473/446
2013/0248066 A1 9/2013 Garcia
2016/0023070 A1 1/2016 Wolfe et al.

* cited by examiner

HEATING A SPORTS DEVICE

CROSS-REFERENCE TO RELATED APPLICATIONS

This application claims priority to U.S. Provisional Application Ser. No. 62/099,215, filed on Jan. 2, 2015, and entitled "HEATED LACROSSE STICK." The content of this application is incorporated by reference herein it its entirety.

BACKGROUND

Lacrosse is a popular sport in North America and throughout the world. The sport requires participants to use a stick to carry, pass, and shoot a ball. Because lacrosse is played throughout the year, and in varying climates, it is not uncommon that participants must play in cold, damp conditions.

SUMMARY

The subject matter disclosed herein relates to sports devices, with particular discussion about improvements that make lacrosse sticks more comfortable to use during these unfavorable conditions. The improvements may sustain surfaces of the lacrosse stick at temperatures that are comfortable to human touch for an extended period of time. This feature may be useful to players that play and practice in cold weather, particularly for those that may suffer from poor circulation in the hands.

Some embodiments are configured as a long-handled implement. These embodiments can have a head that connects to a shaft. During game play, the ball resides in the head. The player holds onto the shaft to perform certain actions with the stick. These actions may be useful to control and eject the ball from the head or, when necessary, to prevent opposing players from obtaining and/or maintaining control of the ball.

Constructions for the shaft may employ a variety of materials and structures. Wood and hardwoods (e.g., hickory) may be used because of its superior strength and rigidity. Players may enjoy the feel of wooden shafts because wood tends to transmit vibrations to the hands to improve feel and control of the ball in the head. Wood can also insulate the player's hands to provide comfort particularly during use in cold weather. Metals, metal alloys, plastics (e.g., polycarbonate), and certain composites may be favored over wood, however, because these materials offer superior physical properties (e.g., shear and tensile strength). Use of aluminum, titanium, scandium, vanadium, as well as carbon fiber and like composites, may leverage the strength-to-weight ratio of these materials to develop lighter and stronger constructions for the shaft. However, unlike wood, these materials tend to be cold to the touch and can strip heat from the player's hands, making use of the shaft particularly uncomfortable in cold weather even with protective gloves that the players use during game play.

As noted more below, some embodiments may be particularly suited to maintain temperature of these wooden and non-wooden shafts. These embodiments can utilize a thermal structure that can retain and dissipate thermal energy. The thermal structure can include a heating element and a thermal store. This thermal store prolongs heat dissipation, effectively maintaining the temperature of the shaft for an extended period of time in lieu of continuous operation of the heating element. The thermal store may include materials of varying phase (e.g., solids, liquids, and gels) and thermal properties. This material may form an interior core (also, "thermal core"). It has been found that rice (or like particulate and/or granulated material) can serve as the thermal core. It is contemplated that other configurations of the thermal core can be optimally arranged to both retain thermal energy from the heating element and to dissipate heat to the shaft.

BRIEF DESCRIPTION OF THE DRAWINGS

Reference is now made briefly to the accompanying figures, in which.

Figure 1:
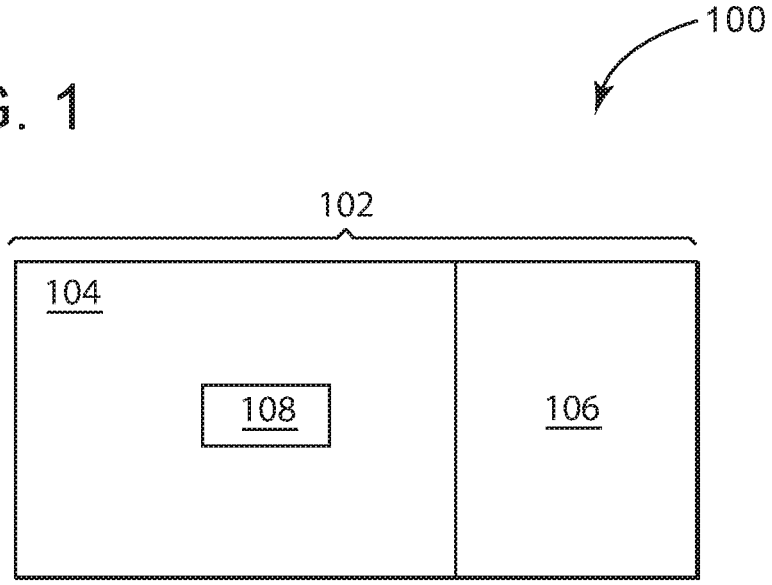
FIG. 1 depicts a schematic diagram of an exemplary embodiment of a sports device that is useful for an individual to play an athletic game.

Where applicable like reference characters designate identical or corresponding components and units throughout the several views, which are not to scale unless otherwise indicated. The embodiments disclosed herein may include elements that appear in one or more of the several views or in combinations of the several views. Moreover, methods are exemplary only and may be modified by, for example, reordering, adding, removing, and/or altering the individual stages.

DETAILED DESCRIPTION

The discussion below describes embodiments of a sports device. These embodiments can take the form of a lacrosse stick, shown and described below, although other sports may have devices (e.g., hockey sticks, baseball bats, etc.) that could benefit from implementation of the concepts herein. In one implementation, the embodiments include materials that can retain and dissipate heat through phase changes, e.g., from solid to liquid, and vice versa. Suitable materials may maximize energy storage per unit volume/mass so as to add little weight to the lacrosse stick but still maintain surfaces at temperatures for extended periods. This feature can make the lacrosse stick comfortable for the player to grasp and to handle during game play and practice. Other embodiments are within the scope of the disclosed subject matter.

FIG. 1 illustrates a schematic diagram of an exemplary embodiment of a sports device 100 that is useful for an individual to play an athletic game. This embodiment includes a body 102 with one or more parts (e.g., a handle 104 and an end effector 106). In one implementation, the sports device 100 can include a heating member 108 that is disposed in and/or incorporated as part of the body 102. The parts 104, 106 can be configured so the individual can grasp the handle 104 to move and/or operate the end effector 106, often to interact with a ball (or puck) during play of the game. In context of the sport of lacrosse, the body 102 can embody a lacrosse stick that a player employs to catch and throw a ball. The parts 104, 106 can embody a shaft and a head on the lacrosse stick, respectively. The head can be configured for the player to receive and carry the ball. The player grasps the shaft to catch and throw the ball from the head.

At a high level, the heating member 108 can be configured to regulate temperature of the handle 104. Some configurations can store thermal energy and, in turn, dissipate the stored thermal energy in a way that sustains the operating temperature of the handle 104 within a range comfortable for a player for an extended period of time. Examples of the heating member 108 may raise the operating temperature of the handle 104 to approximately 140° F. These examples can dissipate heat so that the operating temperature drops slowly, effectively keeping the operating temperature of the handle 104 within approximately X° F. for at least approximately 15 min to approximately 20 min. This feature can maintain the handle 104 at temperatures that are comfortable for a player to utilize the sports device 100, e.g., as might occur in game play and/or practice in cold weather. However, as noted herein, the heating member 108 does not require any external stimulus to maintain the temperature within the operating range for the period of time that the heating member is without power. In this way, the sports device 100 may not need to house and/or carry any power supply on-board the body 102.

Figure 2:
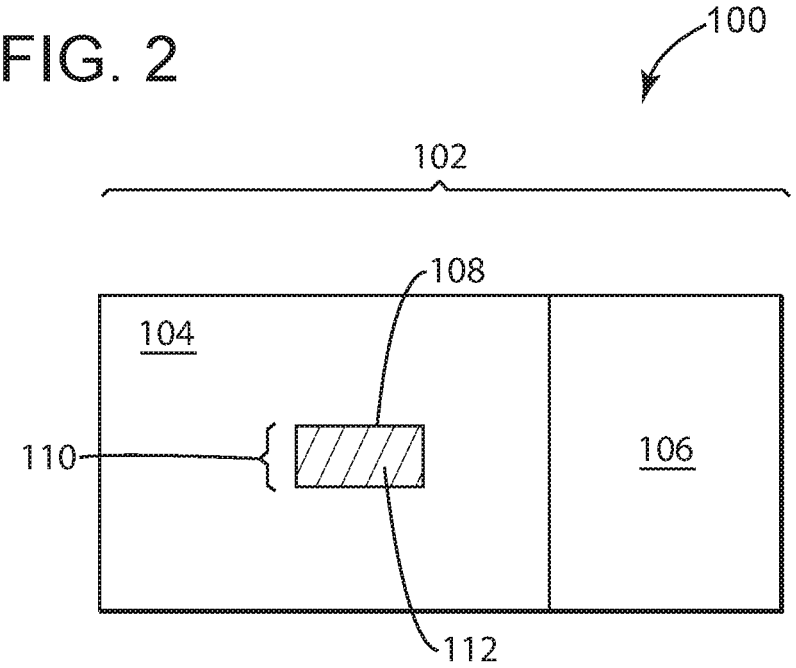
FIG. 2 depicts a schematic diagram of the exemplary embodiment of the sports device of FIG. 1 with an example of a thermal core to store and dissipate heat.

FIG. 2 illustrates a schematic diagram of the sports device 100 that is configured to heat at least the handle 104. The heating member 108 may include a thermal core 110 that incorporates a material 112. The thermal core 110 may reside in the body 102 in position on the interior of the handle 104. The material 112 may comprise a composition that exhibits properties to store and release thermal energy in a manner that can maintain the operating temperature of the handle 104 for the extended period of time. This composition may undergo changes in phase, for example, as between a first phase and a second phase that is different from the first phase. The phase changes can be from solid to liquid and vice versa, but this does not necessarily have to be the case. In one implementation, the composition can absorb and store heat (e.g., latent heat and sensible heat) in response to thermal energy that causes a first phase change from the first phase to the second phase. Exemplary compositions may include "phase change materials" that are organic (e.g., beeswax, paraffin, fatty acids, etc.) and/or inorganic (e.g., salt hydrates, etc.). These phase change materials can slowly release stored latent energy to the handle 104 during a second phase change from the second phase to the first phase.

Phase change materials may be formulated for phase changes at a desired temperature. Exemplary temperatures may be in a range that is comfortable to humans and/or human touch. In use, applying heat to the phase change materials in the first phase increases temperature of the phase change materials from a first temperature to a second temperature that is higher than the first temperature. The phase change materials may change from the first phase to the second phase at the second temperature. During the first phase change (e.g., melting), the phase change materials may continue to absorb heat, but without much, if any, change in temperature away the second temperature. This feature is useful to raise the temperature of the handle 104 to its preferred operating temperature, as noted above. Cooling phase change material induces a second phase change. During the second phase change (e.g. freezing and/or solidification), the phase change material can slowly release the stored thermal energy. In the handle 104, this feature can thwart rapid cooling of the handle 104 to maintain the temperature of the handle 104 at and/or around the operating temperature (or within the operating range) for the player to use the sports device 100 without developing uncomfortably cold hands.

Figure 3:
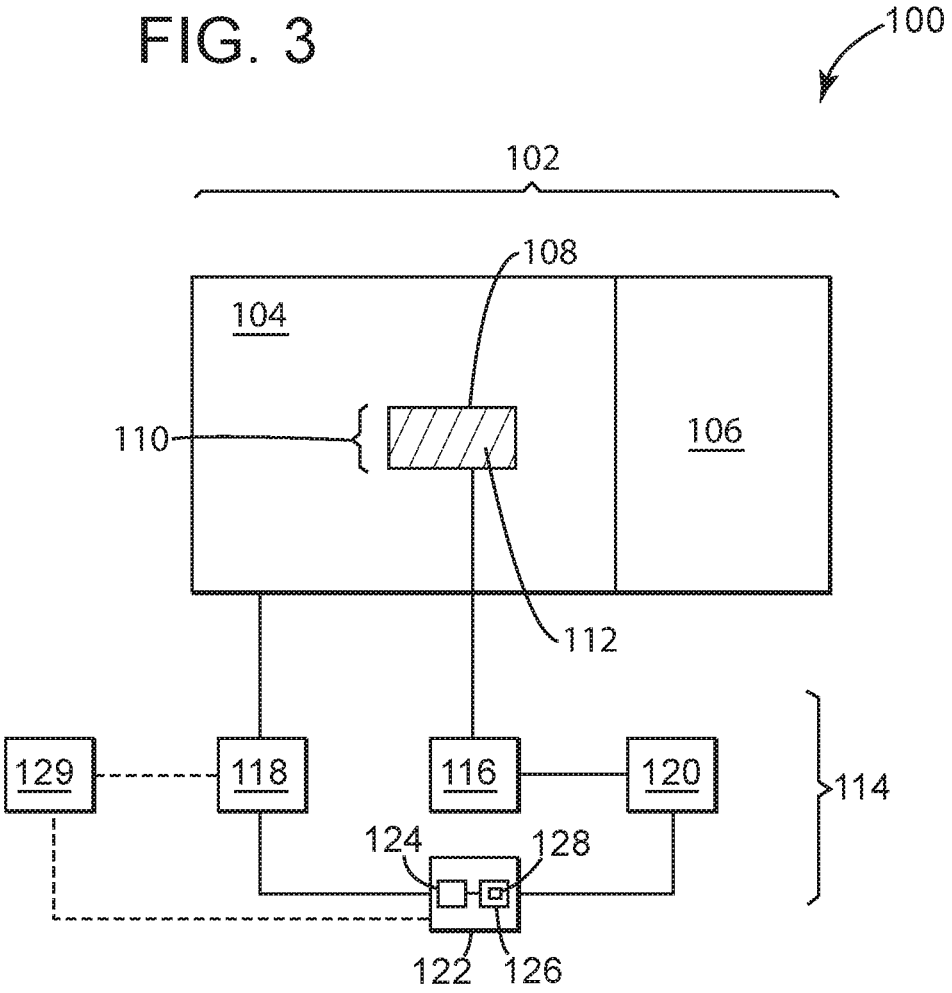
FIG. 3 depicts a schematic diagram of the exemplary embodiment of the sports device of FIG. 1 with an example of a heating system to inject thermal energy to the thermal core.

FIG. 3 illustrates a schematic diagram of an example of collateral components that can provide thermal energy to cause the first phase change of the material 112. These collateral components may form a heating system 114 that heats the composition at least to its melting temperature. The composition may be configured to continue to absorb large amounts energy at the melting temperature (and/or or just above the melting temperature).

As shown in FIG. 3, the heating system 114 may include a heat source 116 and a sensor 118 that couples with the sports device 100. A power supply 120 may provide an electrical stimulus (e.g., current and/or voltage) to the heat source 116. During use, the power supply 120 may be adjusted for proportionate temperature settings on the heat source 116, e.g., low, medium, and high power supply. Examples of the sensor 118 may embody a bi-metal disc thermostat. The sensor 118 may also embody thermistors, thermocouples, and similarly situated devices that can generate a signal in response to temperature on the handle 104. These devices may affix to the handle 104, preferably in locations to avoid interfering with the player's use of the sports device 100. Adhesives and potting materials may be useful for this purpose. The heat source 116 may embody one or more resistive heaters and like devices that generate heat in response to the electrical stimulus from the power supply 120. Suitable resistive heaters may have any one of many form factors, including flat, tubular, coil, etched, or rod-like. The resistive heaters may include various materials including silicone rubber, polymide film, metal wire, metal foils, and ceramics, among others. In one implementation, the heating system 114 may include a control unit 122 to regulate this electrical stimulus. The control unit 122 may have one or more processors 124, storage memory 126, and executable instructions 128 that reside and/or are stored on the storage memory 126. This configuration may be useful to communicate with at least the sensor 118 and the power supply 120 to regulate the electrical stimulus to the heat source 116. For example, the executable instructions 128 can embody computer programs (e.g., software, firmware, etc.) that can configure the processor 124 to turn the power supply 120 on-and-off in response to the signal from the sensor 118. In one implementation, the heating system 114 may include a switch device 129 that couples with the power supply 120 and/or the control unit 122.

The heating system 114 can apply thermal energy to melt the material 112. One or more of the components may be found on-board or off-board the body 102. This disclosure also contemplates configurations that use combinations of on-board and off-board components to apply thermal energy to the material 112. The power supply 120 may comprise a battery, for example one or more lithium ion cells and/or some other electrical storage technology available at the time of the present writing or hereafter developed. The battery may be disposed on-board the body 102. Examples of the switching device 129 can include push button and or actuatable devices that are configured to allow the player to regulate the electrical signal from the power supply 120 to the heat source 116. Such configurations may allow for manual control of the heating system 114, although automated control via the control unit 122 may also cause the switch to actuate as necessary to regulate melting of the material 112.

Figure 4:
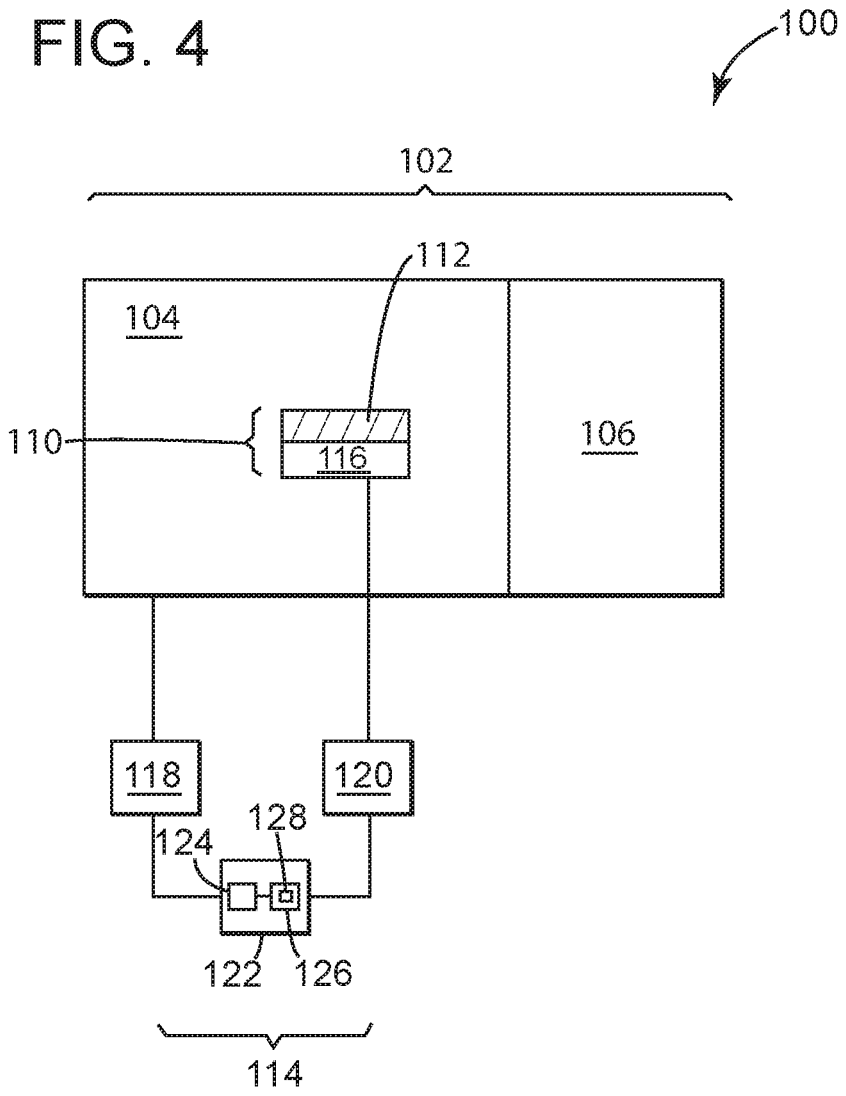
FIG. 4 depicts a schematic diagram of the exemplary embodiment of the sports device of FIG. 1 with an example of a heating system that deploys a heating member on the sports device.
Figure 5:
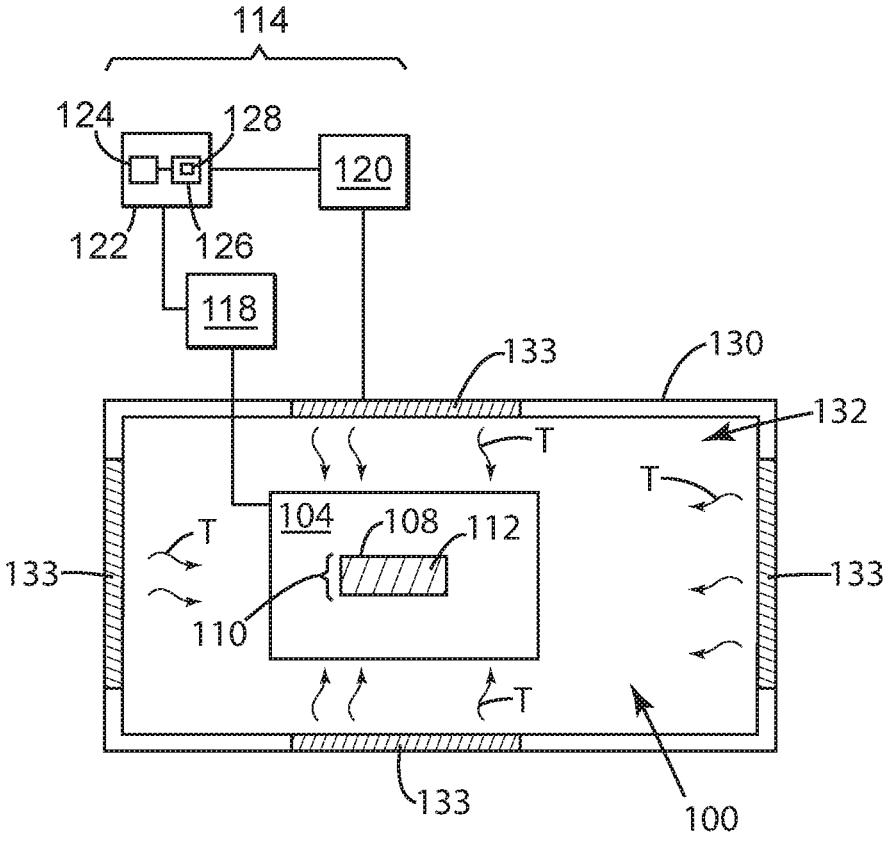
FIG. 5 depicts a schematic diagram of the exemplary embodiment of the sports device of FIG. 1 with an example of a heating system that deploys a heating member remote from the sports device.

FIGS. 4 and 5 depict schematic diagrams for configurations of the collateral components for use with the sports device 100. FIG. 4 illustrates a first configuration that incorporates the heat source 116 on-board the sports device 100. This position allows the heating member to inject thermal energy to the material 112 by way of direct and indirect heat transfer modalities (e.g., conduction, convection, radiation, etc.). Any one of these modalities may cause the phase change (e.g., from solid to liquid) in the composition of the material 112 noted above. In one implementation, the thermal core 110 may be configured to incorporate and/or integrate the heat source 116 into the handle 104. This configuration can place the heat source 116 in direct contact with the material 112. However, this disclosure does contemplate other positions on-board (and off-board or remote from) the handle 104 that can effectuate appropriate transfer of thermal energy to cause the phase change in the composition of the material 112.

FIG. 5 depicts a second configuration that locates the heat source 116 remote from the sports device 100. In this second configuration, the heating system 114 may include a receptacle 130 that defines an opening 132. Examples of the opening 132 can receive at least part of the handle 104 to locate the thermal core 110 proximate the heating member 108. The heat source 116 can couple with the receptacle 130 such as in the form of one or more heating members 133 to inject thermal energy T into the sports device 100. In this respect, the receptacle 130 may be a box, cylinder, and/or bag-like implement, although actually geometry may vary for the receptacle 130. These implements can accommodate one or more of the sports device 100 or thermal cores 110 as desired. This feature may be useful to maintain a plurality of sports devices 100 at comfortable temperatures ready for use by the player. For example, sports teams may benefit from the functionality of the receptacle 130 to maintain temperature of lacrosse sticks, hockey sticks, and bats for many players simultaneously.

Figure 6:
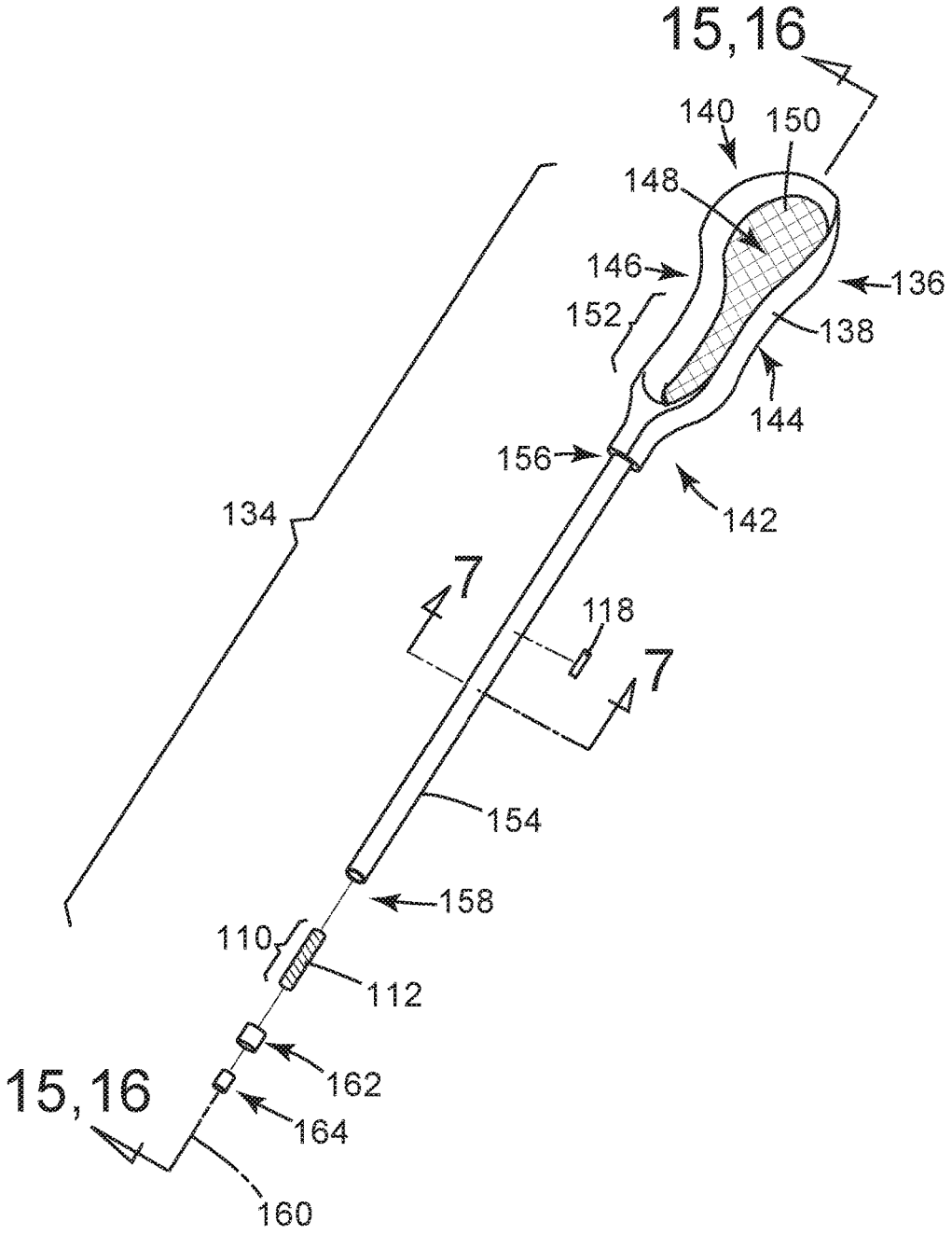
FIG. 6 depicts a perspective view of the front of an example of the sports device in the form of a lacrosse stick in exploded form.

FIG. 6 illustrates a perspective view of the front of an example of the sports device 100 in exploded form. The sports device 100 embodies a lacrosse stick 134 (also, "stick 134"). The end effector 106 includes a head 136 with a frame 138 formed typically as a one-piece or unitary structure of moldable material (e.g., plastic). The frame 138 has a top 140, a bottom 142, and a pair of sidewalls (e.g., a first side wall 144 and a second sidewall 146). These parts collectively bound a central open region 148. The head 136 may include a netting 150 (also, "stringing 150") that spans the frame 138 to cover the open region 148. The stringing 150 can comprise strings or fibers, often individually wound together or provided in a pre-formed webbing. This pre-formed webbing can form a pocket area 152 that may encompass the lower portion or half of the stringing 150 in the head 136. The pocket area 152 is configured to receive and support a ball (not shown) in the open region 148 during use of the stick 134.

The head 136 can couple with the handle 104. In FIG. 6, the handle 104 can embody an elongate shaft 154 with ends (e.g., a first end 156 and a second end 158) and a longitudinal axis 160 extending therebetween. Examples of the elongate shaft 154 can form a cylinder made of metals, composites, metal alloys, plastics, and wood. The cylinder may be hollow, either fully or partially. The bottom 142 of the frame 138 may secure to the cylinder at the first end 156 using a screw and/or fastener. A cap 162 may be configured to couple with the second end 138 to cover an opening to the cylinder. In one implementation, the sports device 100 can include a plug receptacle 164 that is disposed in the cap 162 (in the present example) or elsewhere on the elongate shaft 154.

The plug receptacle 164 may be useful for configurations that mount the heat source 116 (FIG. 4) on-board the handle 104. In use, the plug receptacle 164 can be configured to conduct the electrical signal from the power supply 120 (FIG. 4) to the heat source 116 (FIG. 4). The plug receptacle 164 may also couple with the sensor 118, shown here disposed in position to monitor the operating temperature of the handle 104. Examples of the plug receptacle 164 may use any variety of connections (e.g., post-and-socket, universal serial bus, etc.). Also, although not shown, the sports device 100 may include one or more cables that connect the plug receptacle 164 with the thermal core 110 and/or heat source 116 (FIG. 4) and/or the sensor 118.

Figure 7:
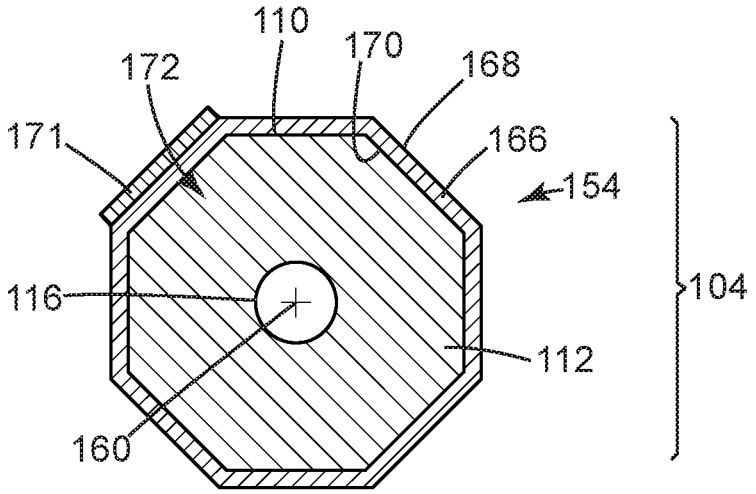
FIG. 7 depicts an elevation view of the cross-section of the sports device of FIG. 6 in assembled form.

FIG. 7 depicts a cross-section view of the sports device 100 in assembled form taken at line 7-7 of FIG. 6. The thermal core 110 is in position in the elongate shaft 154. For reference, the sports device 100 is configured with the heat source 116 on-board the handle 104. This configuration may locate the heat source 116 at or proximate the longitudinal axis 160. The elongate shaft 154 can have a peripheral wall 166 that circumscribes the longitudinal axis 160 to form the cylinder. For hollow cylinders, the peripheral wall 166 can have both an outer surface 168 and an inner surface 170 that bounds an interior cavity 172. Form factors for the cross-section for the peripheral wall 166 may be octagonal, as shown. However, other form factors (e.g., rectangular, annular, elliptical, hexagonal, etc.) may also find use for the handle 104 in certain sports. The sports device 100 may also include a coating 171 that is disposed on the outer surface 168, covering the elongate shaft 154 in whole or in part. Examples of the coating 171 may include materials to improve perception of warmth and/or to provide insulation and/or thermal conductivity to direct a warm sensation to the player's hands. These materials may comprise nylon powders and thermoplastic compositions, although many compositions may be useful for this purpose. In one example, the coating 171 may comprise thermochromic paint or like compositions that can provide a visual indication of temperature and/or temperature changes on the elongate shaft 154.

Figure 8:
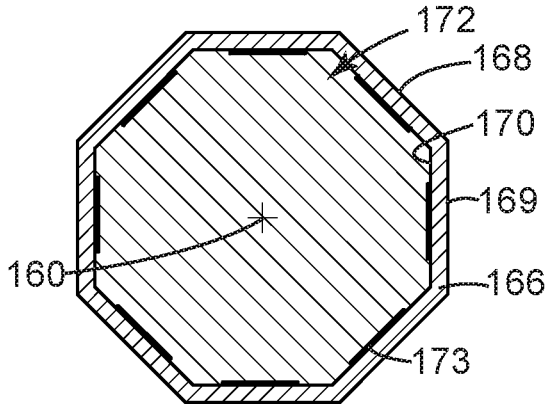
FIG. 8 depicts the cross-section of the sports device of FIG. 7 with an example of a heating member in a first configuration.
Figure 9:
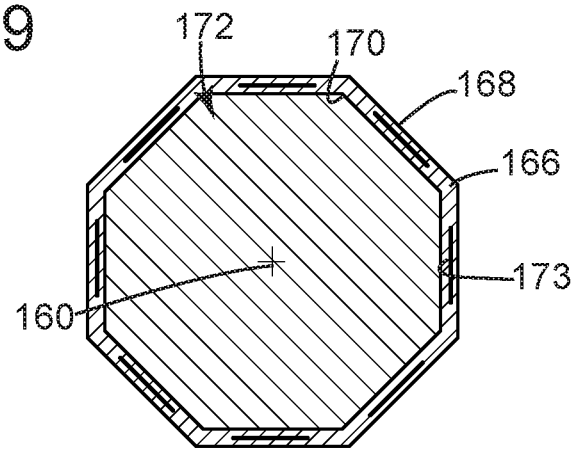
FIG. 9 depicts the cross-section of the sports device of FIG. 7 with an example of a heating member in a second configuration.

FIGS. 8 and 9 depict the cross-section view of FIG. 7 of the sports device 100 to illustrate other locations for the heat source 116. In FIG. 8, the heat source 116 can be arranged integrally and/or monolithically with the peripheral wall 166. This arrangement may utilize one or more resistive members 173 that extend variously along elongate shaft 154. The resistive members 173 may be embedded into the material of the peripheral wall 166. In FIG. 9, the resistive members 173 can couple with the inner surface 168 using adhesives and/or potting materials, although other fastening techniques may be suitable, whether known or developed after the present writing.

Figure 10:
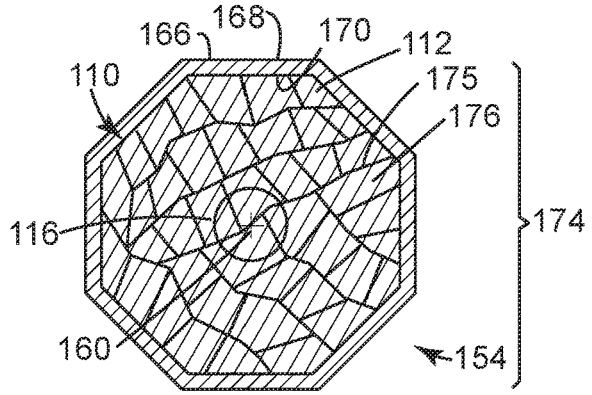
FIG. 10 depicts the cross-section of the sports device of FIG. 7 with an example of the thermal core in the form of a conductive matrix.

FIGS. 10, 11, 12, 13, and 14 depict the cross-section view of FIG. 7 with the sports device 100 in assembled form. These diagrams illustrate several configurations for the thermal core 110 to facilitate the change in temperature of the outer surface 168. For reference, the sports device 100 is configured with the heat source 116 on-board the handle 104 and disposed at or proximate the longitudinal axis 160. In FIG. 10, the thermal core 110 forms a matrix 174 with a structure 175 that creates a plurality of cells 176. The structure 175 can be configured with conductive materials (e.g., metals, conductive plastics, etc.) so as to conduct thermal energy from the material 112 to the peripheral wall 166. This property of the structure 175 can also increase penetration of thermal energy into the material 112 to facilitate efficient melting of the material 112. Such configurations can extend along the longitudinal axis 160 to varying lengths relative to the length of the shaft 154. Examples of the structure 175 can create the cells 176 to effectively compartmentalize the material 112.

Figure 11:
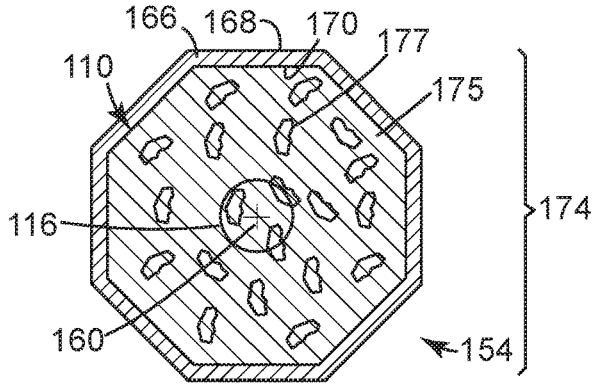
FIG. 11 depicts the cross-section of the sports device of FIG. 7 with the an example of the thermal core in the form of a conductive foam.
Figure 12:
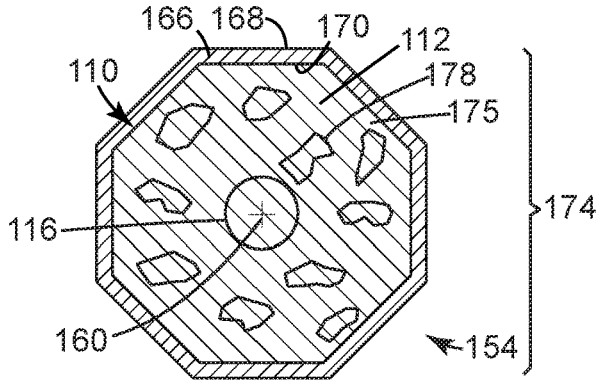
FIG. 12 depicts the cross-section of the sports device of FIG. 7 with an example of the thermal core having conductive impregnated members.

FIGS. 11 and 12 show other configurations for the structure 175. In FIG. 11, the configuration comprises a thermally-conductive foam, either closed cell or open celled. Such foams may be configured with pockets 177 that can entrain and/or trap the material 112. The pockets 177 can hold material 112, with the structure 175 of the foam operating to conduct thermal energy from the material 112 to the peripheral wall 166. In FIG. 12, the structure 175 can include impregnated members 178 that populate the volume of material 112. The impregnated members 178 may comprise graphite particles and/or carbon fibers, although other materials that are thermally conductive may be useful to retain and transfer of thermal energy to the peripheral wall 166.

Figure 13:
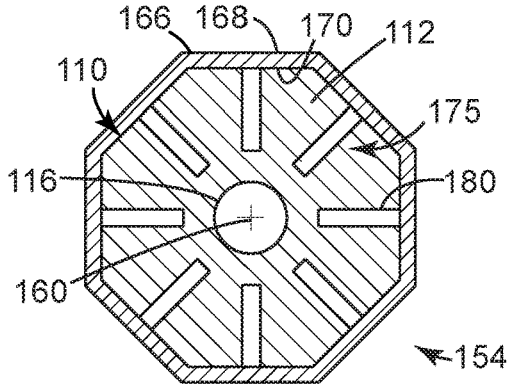
FIG. 13 depicts the cross-section of the sports device of FIG. 7 that is configured with an example of conductive elements.
Figure 14:
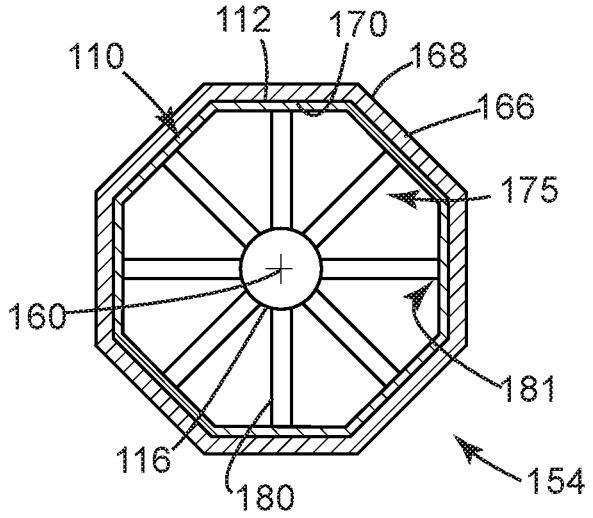
FIG. 14 depicts the cross-section of the sports device of FIG. 7 that is configured with an example of conductive elements.

FIGS. 13 and 14 show a configuration for the structure 175 that can also facilitate transfer of thermal energy from the material 112 to the peripheral wall 166. In these configurations, the sports device 100 can include one or more heat transfer members 180 that interact with the material 112. The heat transfer members 180 may embody thin, thermally conductive elements that are configured to conduct thermal energy from the material 112 to the elongate shaft 154. The elements may couple with the peripheral wall 166, extending generally toward the longitudinal axis 160. These elements may integrate with the peripheral wall 166, as a unitary and/or monolithic unit. In one implementation, the elements may form a separate unit that can insert into the elongate shaft 154 to contact the peripheral wall 166. Examples of the elements (or, "fins") may extend along the longitudinal axis 160 the length of the thermal core 110, although this disclosure contemplates geometry for the fins that extend substantially (e.g., at least 90%) the length of the elongate shaft 154. In FIG. 14, the sports device 100 can include a peripheral chamber 181 to retain the material 112 proximate the peripheral wall 166 of the elongate shaft 154. The peripheral chamber 181 can extend along the longitudinal axis 160. In one implementation, the heat transfer members 180 may couple the centrally-located heat source 116 with the chamber 181. Other implementations may make use of one or more of the peripherally located resistive members 173 (in FIGS. 8 and 9) to facilitate heat transfer to the material 112 in the peripheral chamber 181.

Figure 15:
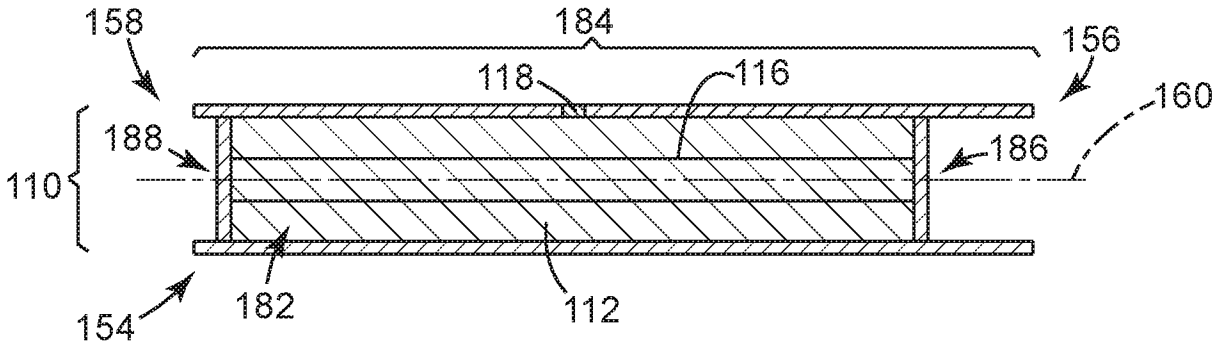
FIG. 15 depicts an elevation view of the cross-section the sports device of FIG. 6 with an example of a shaft that is compartmentalized.
Figure 16:
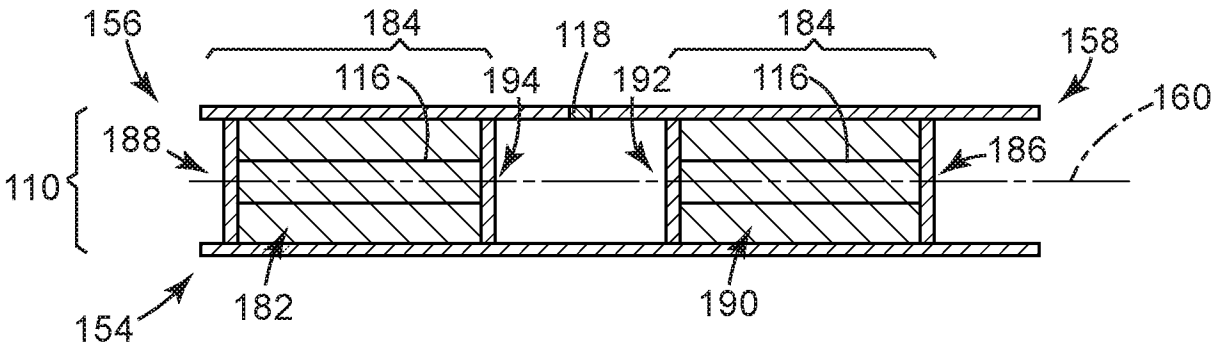
FIG. 16 depicts the cross-section of the sports device of FIG. 15 with an example of a shaft that is compartmentalized.

FIGS. 15 and 16 depict a cross-section of the sports device 100 taken at line 15,16-15,16 of FIG. 6. Several members including the head 136, the cap 162, and the plug member 164 are removed for clarity. For reference, the sports device 100 is configured with the heat source 116 on-board the handle 104 and disposed at or proximate the longitudinal axis 160. In FIG. 15, the sports device 100 can include a heated compartment (e.g., a first compartment 182) that corresponds with a heated portion 184 of the elongate shaft 154. The first compartment 182 can include a first pair of wall members (e.g., a first wall member 186 and a second wall member 188). Materials for the wall members 186, 188 may vary as necessary to comport with the structure of the elongate shaft 154. Epoxy may be useful to effectively "plug" the ends of the first compartment 182. In one implementation, the wall members 186, 188 can couple with the peripheral wall 166 to form a seal that circumscribes the longitudinal axis 160. This seal can be configured to retain liquid in the compartment 182. In the example of FIG. 16, the sports device 100 includes a second compartment 190 with a second pair of wall members (e.g., a third wall member 192 and a fourth wall member 194).

The location of the wall members 186, 188, 192, 194 relative to one another in the elongate shaft 154 can define a volume for the compartments 182, 190. In use, the material 112 resides in the compartments 182, 190, either alone or as part of the matrix 174 for the thermal core 110 discussed above. However, it is also possible to have the material 112 in the intermediary compartment (between wall members 192, 194). When used alone, it may be preferable to use an amount of the material 112 that is equal to and/or fills at least 95% or more of the volume of the compartments 182, 188 in its liquid phase. This amount can be useful to reduce flowing and/or sloshing of the material 112 in its liquid phase inside of the elongate shaft 154 during use by the player.

The volume of the compartments 182, 190 may depend on the position of the wall members 186, 188, 192, 190. The members 186, 188 reside proximate the ends 156, 158 of the elongate shaft 154. This position can maximize the volume the compartment 182 (as shown in FIG. 14) so as to makes the volume of the first compartment 182 substantially the same as the volume of the interior cavity 172 of the elongate shaft 154. Some implementations can allow the members 186, 188 to be set longitudinally inwardly from the ends 156, 158 for purposes of construction and/or ease of manufacturability as necessary. As shown in FIG. 15, the members 192, 194 can be interposed between the members 186, 188. This configuration makes the volume of each compartment 182, 190 less than the volume of the interior cavity 172. The total volume of the compartments 182, 190 may be substantially equal to the volume of the interior cavity 172, as desired.

The heated portion 184 may correspond with an area of the outer surface of the elongate shaft 154 that changes temperature in response to discharge of thermal energy from the material 112 (and/or the thermal core 110, generally). This heated area may extend in various directions on the elongate shaft 154 including longitudinally (along the longitudinal axis 160) and radially (circumscribing the longitudinal axis 160). It may be advantageous to heat all and/or only a portion of the outer surface area of the shaft 154. These heated portions may correspond, for example, with specific locations on the handle 106 that the player is most often to grasp while using the lacrosse stick 134.

Figure 17:
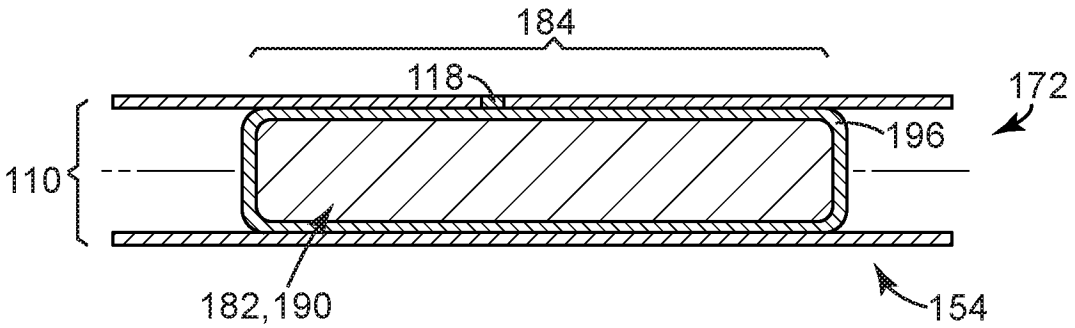
FIG. 17 depicts the cross-section of the sports device of FIG. 15 with an example of a thermal core as a separate and/or replaceable unit.

FIG. 17 depicts the cross-section of FIGS. 15 and 16 to illustrate an example of the thermal core 110. This example can include an outer casing 196 that can form one or more of the compartments 182, 190 in the elongate shaft 154. Examples of the outer casing 196 may form a cylinder that encloses the material 112 therein. This cylinder may slidably insert into the interior cavity 172 to locate in the elongate shaft 154 to form the heated portion 184. The cylinder may couple with the elongate shaft 154 using fasteners (e.g., screws, bolts, etc.), although other techniques (e.g., welds, adhesives, potting, etc.) that are known and/or developed after the present writing may be suited as well. In one implementation, the cylinder may be configured to remove from the elongate shaft 154. This feature may benefit applications in which another one of the thermal core 110 can be separately heated (or "charged") and rapidly secured into the elongate shaft 154 by the player to heat (and/or maintain) the handle 104 at a temperature that is comfortable to the touch.

Figure 18:
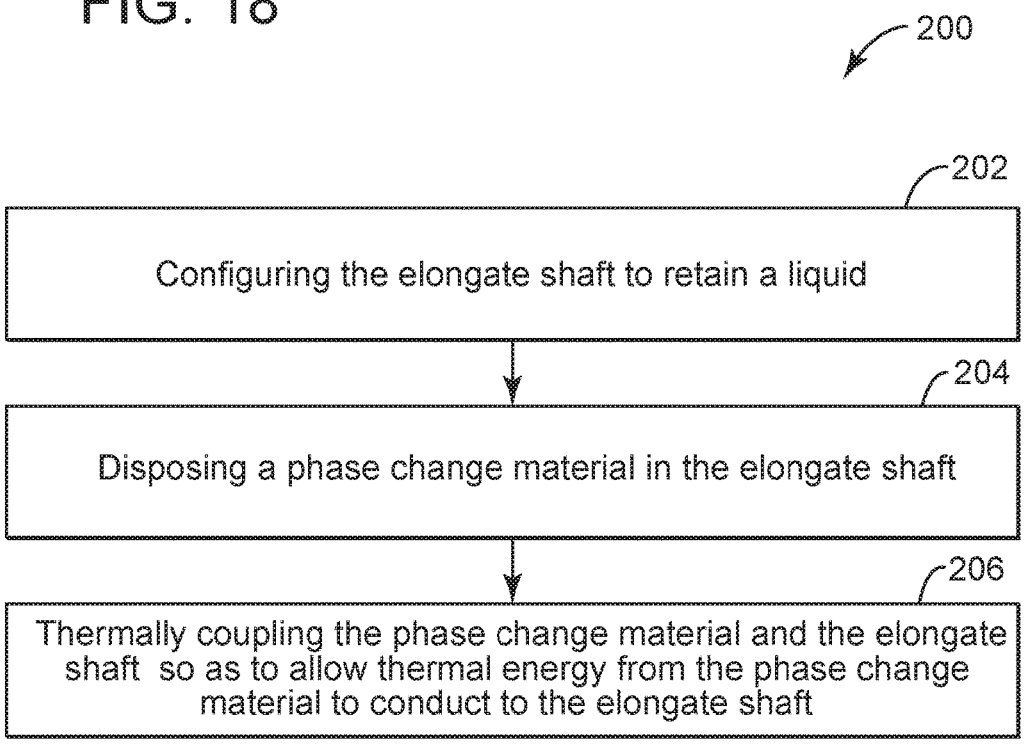
FIG. 18 depicts a flow diagram of an exemplary embodiment of a method for heating a sports device.

FIG. 18 depicts a flow diagram for an exemplary embodiment of a method for heating a sports device. The method 200 can include, at stage 202, configuring the elongate shaft to retain a liquid, at stage 204, disposing a phase change material in the elongate shaft, and, at stage 206, thermally coupling the phase change material and the elongate shaft so as to allow thermal energy from the phase change material to conduct to the elongate shaft. In one implementation, the method 200 may include one or more stages for locating a heater in the phase change material and coupling the heater to a plug member that is configured to receive an electrical signal to operate the heater. The method 200 may also include one or more stages for forming one or more heat transfer member in the elongate shaft, wherein the heat transfer members are thermally coupled to the elongate shaft. The stages also include disposing a conductive matrix in the elongate shaft and disposing the phase change materials in the conductive matrix. In one implementation, the method 200 may include one or more stage for forming one or more compartments in the elongate shaft, wherein the phase change material is disposed in the one or more compartments.

The embodiments herein may incorporate elements and features, one or more of the elements and features being interchangeable and/or combinable in various combinations, examples of which may include a system for heating a sports device, the system comprising a (i) a lacrosse stick comprising an elongate shaft having a peripheral wall forming an interior cavity and a phase change material disposed in the interior cavity and (ii) a heating system thermally coupled with the phase change material to cause the material to change from a first phase to a second phase. In one embodiment, the heating system can comprise a heating member disposed in the interior cavity of the elongate shaft and in thermal contact with the phase change material. In one embodiment, the heating system can comprise a heating member disposed remote from the elongate shaft, wherein the heating member is configured to transmit thermal energy to melt the phase change material.

In view of the foregoing, the embodiments described herein afford players with a sports device, like a lacrosse stick, that is favorable for use in cold weather. These embodiments may use a phase change material to maintain the operating temperature of a part of the sports device (e.g., the shaft of the lacrosse stick) for an extended period of time. This phase change material may be useful because it can store and dissipate thermal energy in a way that can allow the embodiments to achieve comfortable temperatures on the sports device without the need to operate heaters during game play.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lacrosse stick, comprising:

a head having a frame with pre-formed webbing disposed thereon;

an elongate shaft coupled with the head, the elongate shaft having a peripheral wall circumscribing a longitudinal axis to form an interior cavity;

a first pair of wall members disposed in the interior cavity and spaced apart from one another along the longitudinal axis of the elongate shaft, the first pair of wall members coupled with the peripheral wall to form a seal that circumscribes the longitudinal axis to form a first, liquid-tight compartment;

a second pair of wall members disposed in the interior cavity and spaced apart from one another along the longitudinal axis, the second pair of wall members coupled with the peripheral wall to form a seal that circumscribes the longitudinal axis to form a second, liquid-tight compartment;

heating structure disposed in the first, liquid-tight compartment and the second, liquid-tight compartment and configured to induce temperature change in the peripheral wall, the heating structure comprising:

a centrally-located, electrical heating element extending along the longitudinal axis, spaced apart from the peripheral wall between the first pair of wall members in the first liquid-tight compartment and between the second pair of wall members in the second liquid-tight compartment;

a plurality of thermally-conductive fins each coupled on a first end with the centrally, located heating element and extending radially away from the centrally-located, electrical heating element to a second end, a peripheral chamber coupled with the second end of each of the thermally-conductive fins to divide the interior cavity into radially-adjacent smaller sections disposed between the thermally-conductive fins; and a matrix of phase change material having a liquid phase at elevated temperature, disposed in the peripheral chamber, adjacent to the peripheral wall.

2. The lacrosse stick of claim 1, further comprising:

a cap disposed on an end of the elongate shaft; and a plug member disposed in the cap, wherein the plug member couples with the heating member so as to conduct an electrical signal to the heating member.

3. The lacrosse stick of claim 2, further comprising:

a sensor coupled with the elongate shaft and with the plug member, wherein the sensor is configured to generate a signal in response to temperature of the elongate shaft.

4. The lacrosse stick of claim 1, wherein the matrix has a structure that is configured to conduct thermal energy from the phase change material to the elongate shaft.

5. The lacrosse stick of claim 4, wherein the structure of the matrix comprises a thermally conductive foam with pockets dispersed throughout, wherein the phase change material is disposed in the pockets.

6. The lacrosse stick of claim 4, wherein the structure of the matrix forms cells, and wherein the phase change material is disposed in the cells.

7. The lacrosse stick of claim 4, wherein the structure of the matrix comprises a plurality of conductive, impregnated members that are dispersed throughout the phase change material.

8. The lacrosse stick of claim 1, wherein the thermally-conductive fins are part of a separate unit that is configured to insert into the elongate shaft.

9. The lacrosse stick of claim 1, wherein the interior cavity is formed so that the elongate shaft is hollow along its entire length.

10. The lacrosse stick of claim 1, wherein the peripheral wall inserts into part of the head.

11. The lacrosse stick of claim 1, wherein the peripheral wall comprises metal formed in an octagonal shape.

12. The lacrosse stick of claim 1, wherein the peripheral chamber and the thermally-conductive fins are formed monolithically with the peripheral wall.

13. The lacrosse stick of claim 1, wherein the thermally conductive fins are insertable into the interior cavity of the elongate shaft.

14. The lacrosse stick of claim 1, wherein the radially-adjacent smaller sections each have a cross-section that is at least 25% smaller than the cross-section of the interior cavity.

* * * * *